US007387231B2

(12) United States Patent
Yandian et al.

(10) Patent No.: US 7,387,231 B2
(45) Date of Patent: Jun. 17, 2008

(54) CONTAINER INSERT

(75) Inventors: Jeffrey Yandian, Marietta, OK (US); Peter G. Graham, Lucas, TX (US)

(73) Assignee: Pizza Hut, Inc., Dallas, TX (US)

( * ) Notice: Subject to any disclaimer, the term of this patent is extended or adjusted under 35 U.S.C. 154(b) by 636 days.

(21) Appl. No.: 10/900,968

(22) Filed: Jul. 28, 2004

(65) Prior Publication Data

US 2006/0022026 A1 Feb. 2, 2006

(51) Int. Cl.
*B65D 3/22* (2006.01)

(52) U.S. Cl. ..... 229/122.34; 229/906; 229/902

(58) Field of Classification Search ..... 229/122.32, 229/122.34, 114, 906, 902; 206/557, 804, 206/459.5, 488, 489, 784, 562; 426/115, 426/128, 129, 130

See application file for complete search history.

(56) References Cited

U.S. PATENT DOCUMENTS

| | | | | | |
|---|---|---|---|---|---|
| 3,650,383 | A | | 3/1972 | Nigro | |
| 3,759,720 | A | | 9/1973 | Young | |
| 4,211,324 | A | | 7/1980 | Ohlbach | |
| 4,301,960 | A | * | 11/1981 | Alexander et al. | 229/164.1 |
| 4,441,626 | A | | 4/1984 | Hall | |
| 4,592,914 | A | | 6/1986 | Kuchenbecker | |
| 4,979,667 | A | | 12/1990 | Seaman | |
| 5,180,075 | A | * | 1/1993 | Montalbano | 229/103.11 |
| 5,234,158 | A | * | 8/1993 | Storms et al. | 229/104 |
| 5,253,800 | A | | 10/1993 | France | |
| 5,379,934 | A | | 1/1995 | Lorenz | |
| 5,445,286 | A | * | 8/1995 | Guimarin | 229/117.34 |
| 5,476,214 | A | | 12/1995 | Fisk, Jr. | |
| 5,482,724 | A | | 1/1996 | Morici et al. | |
| 5,669,552 | A | * | 9/1997 | Watanabe | 229/114 |
| 5,895,698 | A | | 4/1999 | Cacciatore et al. | |
| 5,900,264 | A | * | 5/1999 | Gics | 426/107 |
| 6,065,669 | A | | 5/2000 | Correll | |
| 6,073,372 | A | | 6/2000 | Davis | |
| 6,601,758 | B2 | * | 8/2003 | Lizzio | 229/120 |
| 2002/0079357 | A1 | * | 6/2002 | Tulkoff | 229/120.32 |

* cited by examiner

*Primary Examiner*—Nathan J Newhouse
*Assistant Examiner*—Christopher Demeree
(74) *Attorney, Agent, or Firm*—Stites & Harbison, PLLC; David W. Nagle, Jr.

(57) ABSTRACT

An insert including a support panel, a first tab, and a second tab. The support panel defining a front edge, a back edge opposite the front edge, a first side edge extending between the front edge and the back edge, and a second side edge extending between the front edge and the back edge opposite the first side edge. The support panel is adapted to support a food product during cutting of the food product and during transfer of the food product to a container. The first tab extends along the first side edge of the support panel from the front edge only partially toward the back edge. The second tab extends along the second side edge of the support panel from the back edge only partially toward the front edge. Other inserts and trays and combinations including inserts or trays provide additional advantages.

10 Claims, 4 Drawing Sheets

CONTAINER INSERT

BACKGROUND OF THE INVENTION

Pizza is one of the most popular food items in the United States. Pizzas come in many different shapes and sizes, with virtually unlimited variation in the types of toppings, meats, vegetables, cheese, doughs/crusts and other ingredients used. Commercial pizza makers with national and international presence, especially pizza restaurants, typically select, develop and promote a number of different pizzas.

Once a pizza is prepared, pizza for take-out or delivery is typically cut and boxed for transport from the pizza restaurant. The pizza is typically cut on a cutting surface prior to placement of the pizza into the pizza box. Placement of each individual piece of pizza into the box with a spatula or other device would be time consuming. As a result, individual piece placement into a box would decrease overall restaurant productivity. On the other hand, sliding of a cut pizza from a pizza peel or paddle into a pizza box can also be problematic as it potentially disrupts the arrangement of cheese and toppings on the pizza, for example. In particular, sliding of the pizza may cause the toppings to slide to undesirably intermingle with each other or to entirely slide off of the pizza crust. In addition, the pieces of pizza may shift, destroying the uniform and aesthetically appealing arrangement of the individual slices of pizza within the pizza box.

Problems associated with transfer of pizza from the cutting table to the box are further exacerbated in instances in which multiple smaller pizzas, composite pizzas, or other multiple food products are desired to be placed within a single pizza box. In particular, due to the individual nature of the separate or composite pizzas, problems with shifting or sliding of toppings or of the smaller individual products themselves are amplified. Similar problems are also encountered with other food products.

SUMMARY OF THE INVENTION

One embodiment of the present invention relates to an insert including a support panel, a first tab, and a second tab. The support panel defining a front edge, a back edge opposite the front edge, a first side edge extending between the front edge and the back edge, and a second side edge extending between the front edge and the back edge opposite the first side edge. The support panel is adapted to support a food product during cutting of the food product and during transfer of the food product to a container. The first tab extends along the first side edge of the support panel from the front edge only partially toward the back edge. The second tab extends along the second side edge of the support panel from the back edge only partially toward the front edge. Other articles, features, and advantages are also disclosed.

BRIEF DESCRIPTION OF THE DRAWINGS

Embodiments of the invention will be described with respect to the figures, in which like reference numerals denote like elements and in which.

DETAILED DESCRIPTION

Figure 1:
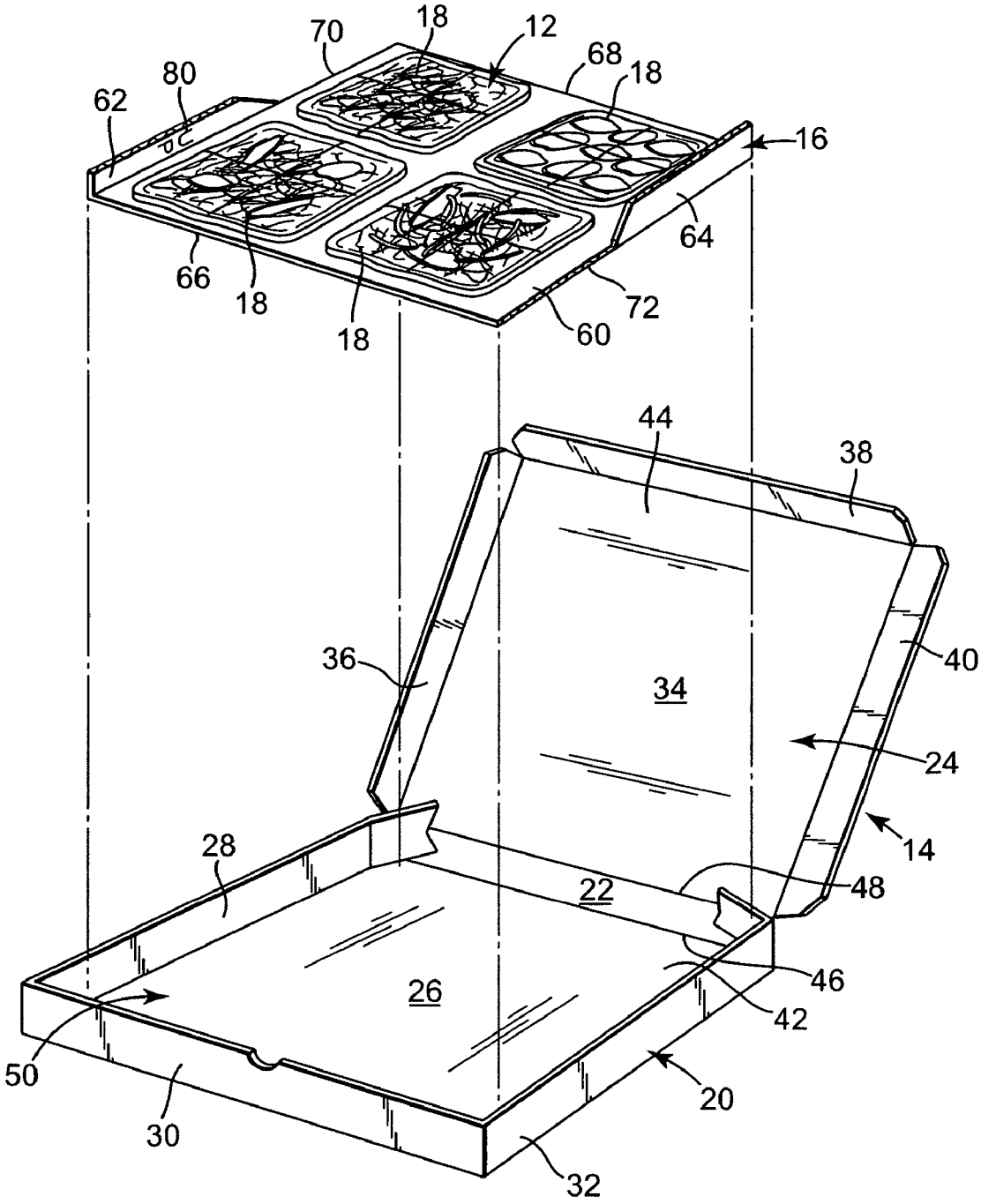
FIG. 1 is an exploded, perspective view of a boxed food article, according to an embodiment of the invention.

FIG. 1 illustrates one embodiment of a box/food combination 10 for transport from a preparation site, such as for delivery to or pickup by a consumer. Combination 10 includes a food product 12, a package or box 14, and a tray or insert 16. Food product 12 is placed upon insert 16 and food product 12 and insert 16 are collectively placed within box 14. When box 14 is closed, food product 12, box 14, and insert 16 can collectively be transported by delivery personnel or by the consumer, for example, with relative ease.

In one embodiment, food product 12 is any edible food product. Food product 12 is e.g. an edible food product 12 benefiting from cutting or other arrangement prior to placement within box 14 and subsequent consumption by the consumer. In one embodiment, food product 12 includes a plurality of food products 18, each requiring cutting or other arrangement prior to placement within box 14 and subsequent consumption by the consumer. In one embodiment, food product 12 is a pizza. In one embodiment, in which the food product 12 is a plurality of food products 18, the plurality of food products 18 are a plurality of pizzas, e.g. a plurality of pizzas backed simultaneously.

In one embodiment, box 14 is a pizza box, such as a conventional pizza box. Accordingly, a unitary, double-sided corrugated cardboard piece is folded about a plurality of scored or perforated lines to enable the unitary cardboard piece to form box 14. More specifically, in one embodiment, box 14 defines a bottom panel 20, a central panel 22, and a top panel 24. In one embodiment, bottom panel 20 includes a main portion 26 and side walls 28, 30, and 32. Main portion 26 is substantially rectangular and substantially planar. Side walls 28, 30, and 32 each extend from an edge of main portion 26.

In one embodiment, central panel 22 is substantially elongated and rectangular. Central panel 22 extends from main portion 26 on an edge not coupled to side wall 28, 30, or 32. More specifically, central panel extends from main portion 26 a distance substantially equal to or greater than the extension of each of the sides walls 28, 30, and 32 from main portion 26. In one embodiment, top panel 24 includes a main portion 34 and side walls 36, 38, and 40. Main portion 34 is sized substantially similar to main portion 26 of bottom panel 20. One edge of main portion 34 is coupled to central panel 22 opposite main portion 26 of bottom panel 20. Side walls 36, 38, and 40 extend from the three edges of main portion 34 not coupled with central panel 22.

In one embodiment, at least a portion of inside surfaces 42 and 44 of bottom panel 20 and top panel 24, respectively, are coated with an oil barrier coating to generally prevent grease or other fluid and semi-fluid components of food product 12 from penetrating through panels 20 and/or 22 and onto clothes, auto seats, or anything else which may come in contact with the outside of box 14. In one embodiment, box 14 is scored or perforated along an interface 46 between bottom panel 20 and central panel 22 and along an interface 48 between top panel 24 and central panel 22, respectively, to facilitate folding and assembly of box 14. In particular, upon full assembly, box 14 is folded along interfaces 46 and 48 such that top panel 24 is aligned and positioned directly opposite bottom panel 20 and such that side walls 28, 30, and 32 fit around side walls 36, 38, and 40.

To this end, in one embodiment, bottom panel 20 acts as a base whereas top panel 24 acts as a cover. Notably, top panel 24 and bottom panel 20 are sized such that upon closing box 14, side walls 36, 28, and 40 tightly fit around and interact with side walls 28, 30, and 32 to generally prevent lifting of top panel 24 away from bottom panel 20 without the application of deliberate force. Accordingly, bottom panel 20 and central panel 22 collectively define a cavity 50 that is selectively capped by top panel 24.

Figure 2:
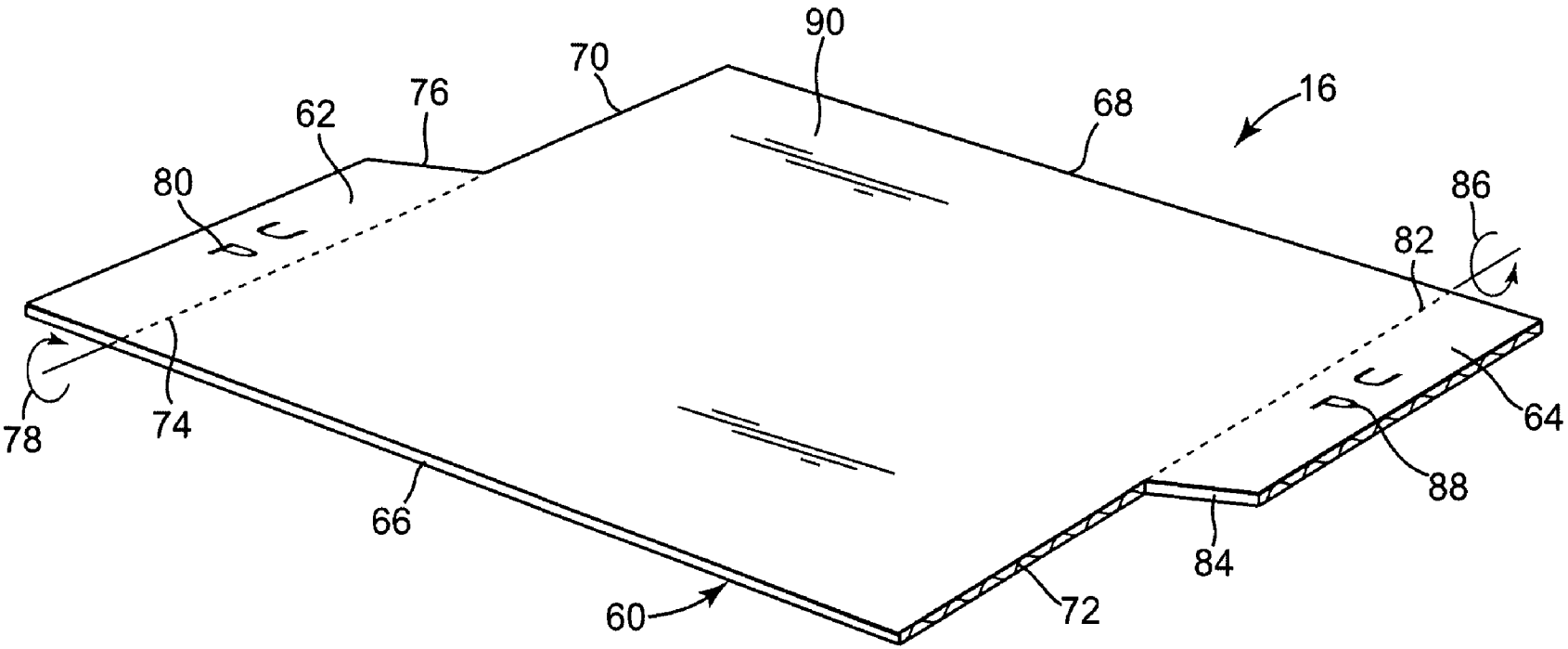
FIG. 2 is a perspective view of an insert of the boxed food article of FIG. 1, according to an embodiment of the invention.

One embodiment of insert 16 is generally illustrated in FIG. 2. Insert 16 includes a support panel or member 60, a first tab or handle 62, and a second tab or handle 64. Support panel 60, first tab 62, and second tab 64 are each integrally formed of a single material. In one embodiment, support panel 60, first tab 62, and second tab 64 are collectively formed of a single piece of corrugated cardboard medium, such as a corrugated, double-faced cardboard. Other materials, such as paper, plastic, etc. are also contemplated. In one embodiment, the corrugated cardboard medium is formed of an E-flute corrugated, double-faced cardboard. In one embodiment, support panel 60, first tab 62, and/or second tab 64 are formed of a material having a combination of a sufficiently small thickness and a sufficiently high density to decrease absorption of cutting blade energy, which would inhibit cutting of food product 12, as will be further described below.

Support panel 60 defines a front edge 66, a back edge 68, a first side edge 70, and a second side edge 72. In one embodiment, support panel 60 is substantially rectangular and front edge 66 is opposite back edge 68. Although defined herein as front and back edges 66 and 68, during use, in one embodiment, insert 16 is orientable such that front edge 66 may be back edge 68 and vice versa. Side edges 70 and 72 of support panel 60 extend between front 66 and back 68 opposite one another.

First tab 62 is initially positioned on a common plane with support panel 16. More specifically, in one embodiment, first tab 62 is coupled with support panel 60 at first side edge 70 to define a linear interface 74 between first tab 62 and support panel 60. In one embodiment, first tab 62 is positioned relatively near front edge 66 relative to back edge 68 of support panel 60. In one embodiment, first tab 62 extends along first side edge 70 in a position substantially flush with front edge 66 partially toward back edge 68, for example, along one of substantially half of substantially half or less than half of a length of the first side edge. In one embodiment, a back edge 76 of first tab 62, which is opposite front edge 66, is angled back toward first side edge 70. Accordingly, first tab 62 is generally trapezoidal. In other embodiments, first tab 62 extends entirely along first side edge 70 or partially along any portion of first side edge 70.

In one embodiment, interface 74 between first tab 62 and support panel 60 is scored or perforated to facilitate rotation or folding of first tab 62 about interface 74 as indicated by rotation arrow 78. In one embodiment, first tab 62 includes indicia 80 generally indicating the proper orientation of insert 16 during use, for example which side of insert 16 should be facing up during use. Indicia 80 are printed, stamped, perforated, indented, or otherwise formed on first tab 62.

Second tab 64 is coupled with second side edge 72 of support panel 60 in a similar manner as first tab 62 is coupled with support panel 60 at first side edge 70. Accordingly, second tab 64 is also initially formed on a common plane with support panel 60. In addition, a generally linear interface 82 is defined between second tab 64 and support panel 60. In one embodiment, second tab 64 is coupled with second side edge 72 from first side edge 70 in a position substantially flush with back edge 68 and extending only partially towards front edge 66, for example, along one of substantially half or less than half of a length of the second side edge 68. In one embodiment, a front edge 84 of second tab 64, which is opposite back edge 58, is angled toward second side edge 72 of support panel 60. Accordingly, second tab 64 is generally trapezoidal. In other embodiments, second tab 64 extends entirely along second side edge 72 or partially along any portion of second side edge 72.

In one embodiment, interface 82 is scored or perforated in order to facilitate rotation or folding of second tab 64 about the interface 82 as indicated by arrow 86. In one embodiment, second tab 64 includes indicia 88, which generally indicate the proper orientation of insert 16 during use, for example, which side of the insert should be facing up during use. Indicia 88 are printed, stamped, perforated, indented, or otherwise formed on second tab 64. In one embodiment, other indicia (not illustrated) are additionally or alternatively included on support panel 60.

When tabs 62 and 64 are folded to extend in an angular manner from support panel 60, tabs 62 and 64 can be easily grasped by a consumer or a user to manipulate and translate the entirety of insert 16. In one embodiment, first and second tabs 62 and 64 are configured such that first tab 62 rotates about interface 74 in a clockwise direction (arrow 78) to extend from support panel 60 in a substantially perpendicular manner, and second tab 64 is configured to rotate about interface 82 in a counterclockwise direction (arrow 86) to extend from main panel 60 in a substantially perpendicular manner. Notably, in one embodiment, first and second tabs 62 and 64 are each sized such that upon rotation of tabs 62 and 64, tabs 62 and 64 extend from support panel 60 a distance greater than an overall height of food product 12 or plurality of food products 18. Moreover, in one embodiment, each tab 62 and 64 extends from support panel 60 a distance less than the extension of side walls 28, 30, and 32 of bottom panel 20 from main portion 26.

In one embodiment, tabs 62 and 64 are configured to facilitate manufacture of insert 16 by allowing multiple inserts 16 to be cut from adjacent portions of the stock material with little or no waste stock material between inserts 16. In particular, in one embodiment, multiple inserts 16 are sequentially laid out on the stock board or material for subsequent cutting such that a second tab 64 of a second insert (not shown) is adjacent to back edge 76 of first tab 62 as well as first side edge 70 of first insert 16. The adjacent or side-to-side configuration of tabs 62 and 64 on stock board prevents excess waste of the stock board during manufacture of a plurality of inserts, and thereby, decreases overall insert production costs.

In one embodiment, a coating 90 is placed upon at least one surface of support panel 60 and/or first and second tabs 62 and 64 to prevent absorption of grease or other components of food product 12 and to resist cutting (i.e. to prevent absorption of blade force during cutting). In one particular embodiment, support panel 60 and/or first and second tabs 62 and 64 are coated with an oil barrier coating 90 to prevent or decrease absorption of blade energy and grease or other components of food product 12.

Figure 3:
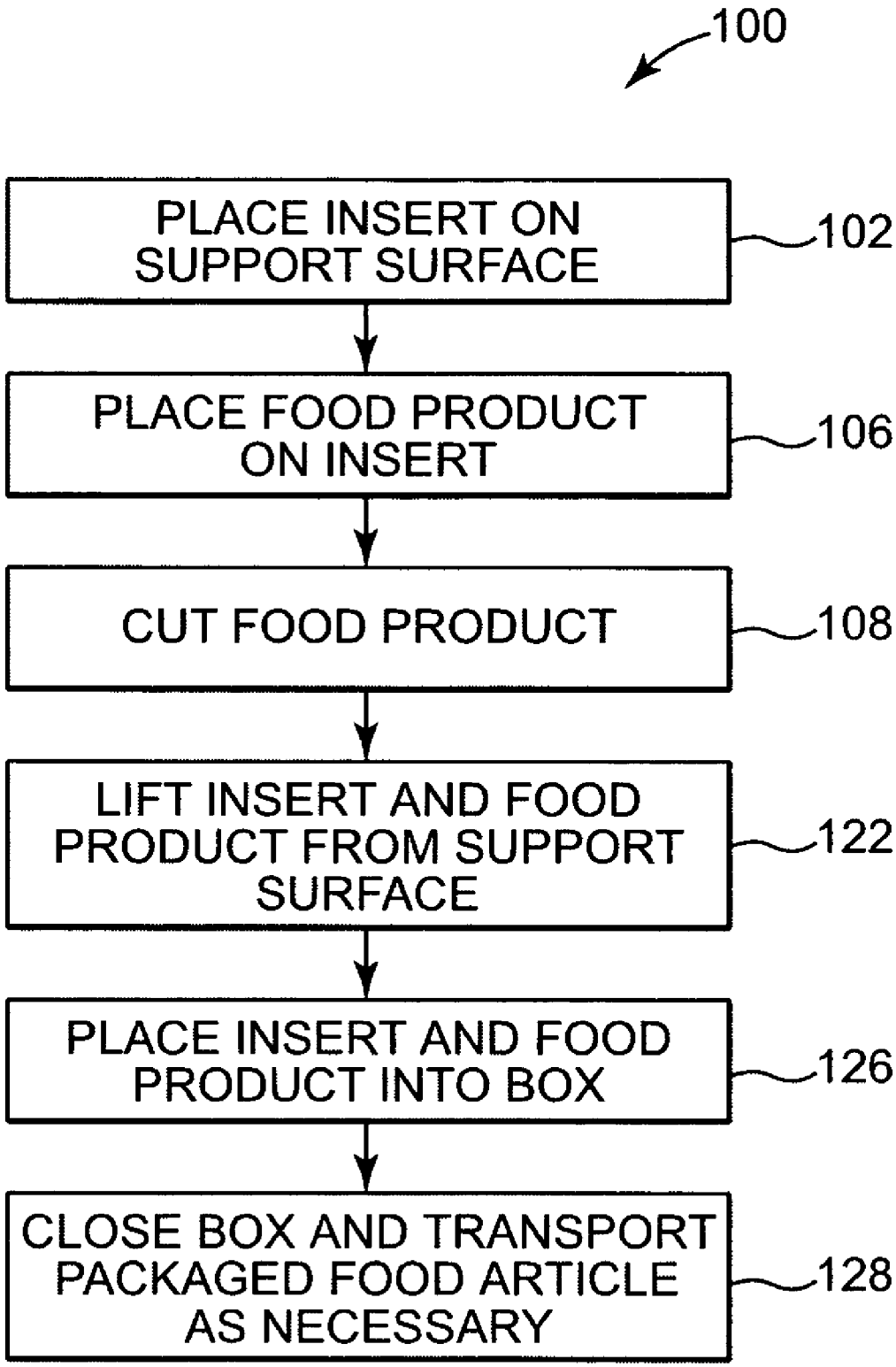
FIG. 3 is a flow chart illustrating a process of cutting and transferring a food product from a cutting table to a box to form the boxed food article of FIG. 1, according to an embodiment of the invention.

FIG. 3 illustrates one embodiment of a process for cutting and boxing pizza 12 generally at 100. At 102, insert 16 is placed on a support surface 104, such as a table, counter, cart, peel, etc., capable of maintaining insert 16 a distance from the ground during cutting of pizza 12. In one embodiment, insert 16 is placed on support surface 104 such that front edge 66 is nearer the user than back edge 68. In one embodiment, insert 16 is placed upon support surface 104 such that the directional indicia 80 and/or 88 is upright and easily readable to the user. In particular, insert 16 is placed upon support surface 104 such that the surface of insert 16 having an oil barrier coating 90 faces up (i.e., is positioned opposite support surface 104). In one embodiment, first and second tabs 62 and 64 are each folded about the respective interface 74 and 82 to effectively "break-in" tabs 62 and 64 for subsequent rotation upon lifting of insert 16 from support surface 104, as will be further described below. Such movement of tabs 62 and 64 moves tabs 62 and 64 out of the common plane with support panel 60.

Figure 4:
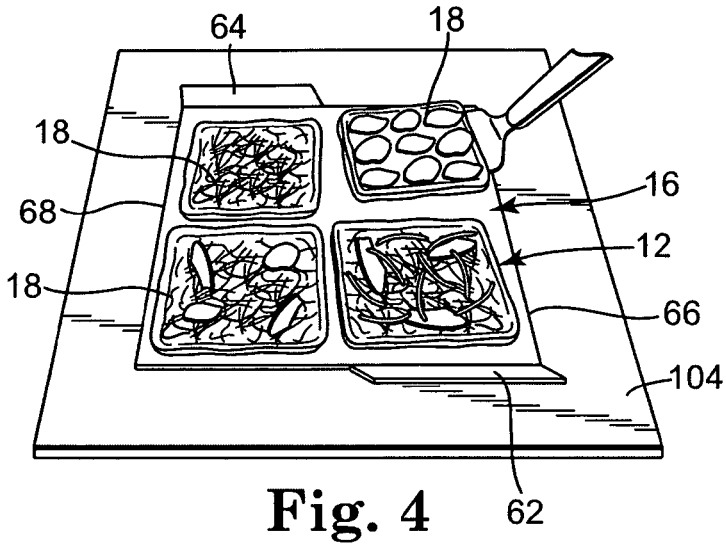
FIG. 4 is a perspective view of the placement of multiple pizzas onto the insert of FIG. 2, according to an embodiment of the invention.

At 106, pizza 12 is placed upon support panel 60 of insert 16 opposite support surface 104 as illustrated with additional reference to FIG. 4. In one embodiment, in which food product 12 is a plurality of individual cooked pizzas 18, each pizza 18 is arranged adjacent to each other on support panel 60. In one embodiment, the plurality of pizzas 18 includes four pizzas each positioned on a respective quadrant of support panel 60.

Figure 5:
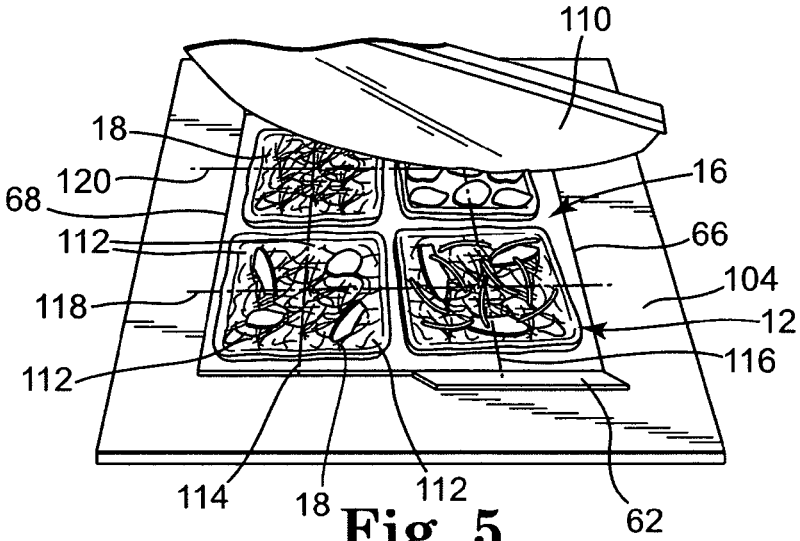
FIG. 5 is a perspective view of cutting of the pizzas of FIG. 4, according to an embodiment of the invention.

Following placement of pizza 12 upon insert 16, at 108, a blade, knife, cutting wheel, etc., such as a blade 110, is used to cut pizza 12 as illustrated with additional reference to FIG. 5. In one embodiment, blade 110 is used to cut each of the plurality of pizzas 18 into four pieces or quadrants 112 to facilitate subsequent consumption by consumers. In one embodiment, pizzas 18 are aligned with each other and cut into quadrants 112 by drawing blade 110 in four passes 114, 116, 118, and 120 wherein each blade pass 114, 116, 118, and 120 cuts into and through at least two of the plurality of pizzas 18.

In particular, each blade pass 114, 116, 118, and 120 fully cuts through each contacted pizza 18 while not substantially penetrating into support panel 60 of insert 16. In particular, the material used to define support panel 60 has a thickness and a density configured to generally decrease absorption of blade energy by main panel 60 with cutting blade 110 during passes 114, 116, 118, and 120, to reduce the likelihood of incomplete cuts through pizza 12. In addition, the oil barrier coating generally prevents pizza grease, steam, etc. from soaking into support panel 60 from pizza 12.

Figure 6:
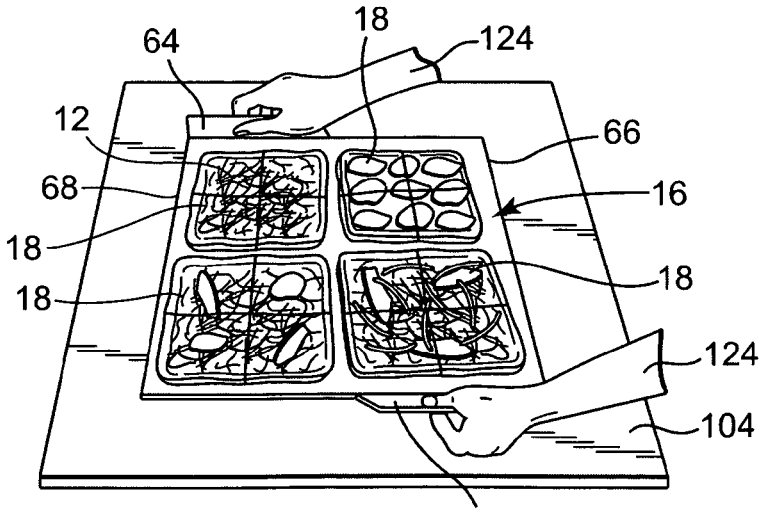
FIG. 6 is a perspective view of lifting the pizzas and package insert of FIG. 5 from a support surface, according to an embodiment of the invention.

When pizza 12 has been arranged and cut upon support panel 60, at 122, insert 16 is lifted from support surface 104. In particular, tabs 62 and 64 grasped by a user 124 and are rotated up from support panel 60 about interfaces 66 and 72, respectively (see arrows 78 and 86 of FIG. 2) as generally illustrated in FIG. 6. Notably, as illustrated, in one embodiment, tabs 62 and 64 extend from main panel a distance further than the extension of pizza 12 from support panel 60 to allow user 124 to grasp tabs 62 and 64 without contacting or contaminating pizza 12, which may, in turn, prevent burning, injury, or soiling of user 124 or deformation or soiling of pizza 12. Upon grasping or lifting of tabs 62 and 64, insert 16 maintains support panel 60 in a substantially level manner such that pizza 12 is evenly supported on insert 16.

At 126, user 124 places insert 16, and therefore pizza 12, into cavity 60 of box 14 as generally illustrated in FIG. 1. In particular, insert 16 fits within cavity 60 such that front edge 66 is relatively near and substantially parallel with side wall 30, back edge 68 is relatively near and substantially parallel with central panel 22, first side edge 70 is relatively near and substantially parallel with side wall 28, and second side edge 72 is relatively near and substantially parallel with side wall 32. In one embodiment, side walls 28, 30, and 32 as well as central panel 22 each extend from bottom panel 20 a distance sufficient to extend above the extension of tabs 62 and 64 and pizza 12 from support panel 60 and, therefore, bottom panel 20 when placed within cavity 60 of box 14. In this manner, pizza 12, and in one embodiment, the plurality of pizza pieces 14 can be placed within cavity 60 of box 14 in an orderly and aesthetically appealing manner, rather than in a haphazard manner that could lead to inadvertent mixing, loss of toppings, or consumer displeasure.

At 128, box 14 is closed and box/food combination 10 is transported as necessary for subsequent consumption of pizza 12 by the consumer. In particular, central panel 22 is rotated about interface 38 and top panel 24 is rotated about interface 40 of box 14 to close box 14 by placing top panel 24 directly opposite bottom panel 20. When directly opposite bottom panel 20, top panel 24 is positioned such that side walls 34, 36, and 38 fit tightly around side walls 28, 30, and 32 of bottom panel 20. Once closed, box/food combination 10 is ready for transportation by delivery or via consumer pickup. Notably, insert 16 also facilitates simultaneous removal of entire pizza 12 for subsequent consumption. Following removal or consumption of pizza 12 from box 14 and insert 16, box 14 and insert 16 are readily disposable in similar manners such as via a trash, garbage, or recycling receptacle.

A tray or insert according to embodiments of the present invention facilitates cutting and subsequent positioning of a food product, such as pizza or a plurality of pizzas, within a box for transport to an area for consumption. In particular, by providing a single surface to serve as a cutting surface and a support surface, handling of the food product is decreased, thereby decreasing the probability that the food product will be disrupted or contaminated during packaging. In addition, the insert increases productivity by providing a quick and easy way of aesthetically arranging the food product prior to cutting of the food product. By saving boxing time and decreasing food product deformities, the tray or insert of the present invention saves a pizza restaurant money in the form of increased productivity and decreased product waste. In addition, by contributing to overall customer satisfaction, the insert increases the chance or repeat customer patronage of the pizza restaurant.

What is claimed is:

1. A combination comprising:

a plurality of individual food products;

a box configured to enclose the plurality of food products during transport of the food products, the box including a bottom panel having a substantially planar main portion and a top panel having a substantially planar main portion, the top panel movable between a closed position when the main portion of the top panel is positioned opposite the main portion of the bottom panel, and an open configuration when the top panel is moved away from the bottom panel; and a tray including:

a substantially rigid planar member for supporting all of the plurality of food products, the planar member defining a front edge, a back edge opposite the front edge, a first side edge extending between the front edge and the back edge, and a second side edge extending between the front edge and the back edge opposite the first side edge;

a first projection extending from the front edge along one of substantially half or less than half of a length of the first side edge of the planar member; and a second projection extending from the back edge along one of substantially half or less than half of a length of the second side edge of the planar member;

wherein the first projection and the second projection are adapted to be grasped to manipulate positioning of the tray and the food products;

wherein the tray with the plurality of food products supported thereon is placed into and removed from the box in a direction substantially perpendicular to the substantially planar main portion of the bottom panel when the top panel is in the open position.

2. The combination of claim 1, wherein the first projection and the second projection are substantially trapezoidal.

3. The combination of claim 1, wherein the planar member, the first projection, and the second projection are each collectively defined by a piece of cardboard material.

4. The combination of claim 3, wherein the piece of cardboard material is formed of an E-flute cardboard.

5. The combination of claim 1, wherein the planar member is generally resistant to cutting blade forces.

6. The combination of claim 1, wherein at least one surface of the planar member is coated with an oil barrier coating.

7. The combination of claim 1, wherein the box includes a base defining a cavity with an opening and a lid configured to cover the opening, and further wherein the tray and the plurality of food products are collectively adapted to fit within the covered cavity.

8. The combination of claim 1, wherein the plurality of food products are a plurality of pizzas and the box is a pizza box.

9. The combination of claim 1, wherein the plurality of food products are unpackaged upon placement upon the tray.

10. The combination of claim 1, wherein the tray includes at least one indicia of a proper orientation of the tray during use.

* * * * *